United States Patent [19]

Mosier

[11] 4,393,637

[45] Jul. 19, 1983

[54] WOOD ROOF TRUSS CONSTRUCTION

[76] Inventor: Leo D. Mosier, 322 Euclid, Sheboygan, Wis. 53081

[21] Appl. No.: 196,075

[22] Filed: Oct. 10, 1980

[51] Int. Cl.[3] ..... E04B 1/32

[52] U.S. Cl. ..... 52/644; 52/225; 52/640; 52/642

[58] Field of Search ..... 52/644, 640, 641, 225, 52/226, 642, 86, 693

[56] References Cited

U.S. PATENT DOCUMENTS

| | | | |
|---|---|---|---|
| 1,360,509 | 11/1920 | Eleman | 52/644 |
| 1,973,882 | 9/1934 | Pratt | 52/642 |
| 2,139,363 | 12/1938 | Graham | 52/642 |
| 2,187,009 | 1/1940 | Beattie | 52/642 |
| 2,525,974 | 10/1950 | Taggart | 52/644 |
| 2,770,846 | 11/1956 | Findleton | 52/642 |
| 4,275,537 | 6/1981 | Pinson | 52/644 |

FOREIGN PATENT DOCUMENTS

| | | | |
|---|---|---|---|
| 7559 | 5/1928 | Austria | 52/642 |

OTHER PUBLICATIONS

Engineering in Timber by The Timber Engineering Company of Washington D.C.

*Primary Examiner*—John E. Murtagh
*Assistant Examiner*—Henry E. Raduazo
*Attorney, Agent, or Firm*—Silverman, Cass & Singer, Ltd.

[57] ABSTRACT

A wood roof truss construction comprising, in combination, a pair of redundant superpositioned load support systems, namely a tied-arch system and a wood bowstring truss system. The wood truss system comprises an arch, a web system depending from said arch and a horizontally oriented bottom bichord member secured to the web system and bridging the ends of the arch and anchored to said ends by a U-strap. A connecting assembly is coupled to the U-strap and to an elongate steel tension rod disposed between the two members forming the bottom bichord. Transverse spacers are provided along the length of the bichord comprising spacer sleeves, through-bolts and/or U-plates coupling the gusset plates or straps employed to anchor the web members to the bottom bichord said transverse members serving also to support the tension rod in the absence of being fixedly secured thereto.

14 Claims, 7 Drawing Figures

WOOD ROOF TRUSS CONSTRUCTION

BACKGROUND OF THE INVENTION

This invention relates generally to load supporting constructions such as roof truss structures and more particularly, provides an improved wood roof truss construction formed of a pair of redundant superpositioned load resisting systems in additive combination, namely, a tied-arch system superpositioned upon a determinate wood bowstring truss system, said systems consisting of top and bottom chords, interconnecting web formation, the top chord being common, said truss including a horizontally oriented tension rod connected only to the bearing ends of the wood truss and not to the bottom chord.

Therefore are many and diverse competing load resisting (supporting) structural systems, both in bridge design and building construction. Systems like the tied cresent-arch system comprise a pair of top arched chords secured at their ends and having differing radii of curvature. A web structure bridges the space between the top arched chord pair along the length thereof. A horizontally oriented tie-rod bridges the ends of said arched chords. Vertically oriented rods are secured between the lower one of the arched chords and the tie-rod. This structure employs an inordinate number of curved members, has complex geometry and is too costly.

A three-hinged trussed arch is another well-known load-resisting support structure. This construction involves an upper arch formed of a pair of bowstring truss structures joined end to end to define the upper arch. The free ends of such arch are bridged by a horizontally oriented tie-rod or bottom chord, same being coupled to and supported from the upper arch by vertically oriented hanger rods fixedly secured thereto. This system also is complex geometrically and very expensive to construct and install.

The conventional tied-arch load supporting system is employed for bridging spans in the range of 50 to 80 feet for relatively small building constructions. The conventional tied arch system comprises, generally, a continuous wood arch member functioning as the top chord and a bottom chord comprising a tie rod secured to the top chord at opposite ends. Vertically oriented, spaced hanger rods are secured to the tie rod along the length of the tied-arch. The quantity of wood required for this system is substantial because a large quantity of wood is required to form a stable arch capable of resisting severe unbalanced loading. For example, the volume of wood required to form the top chord of a tied-arch system is about three times as much as that required to provide the top chord of the conventional bowstring wood truss. These members must be formed of glue-laminated wood members, costing in the range of three to five times the cost of common cut-lumber. One advantage of the tied-arch system is the absence of distracting web structures as a mar to its appearance as compared to the appearance of the conventional bowstring truss conventionally dominating industrial applications.

The conventional wood bowstring truss construction employs a wood top arch similar to that of the tied-arch system and a wood bottom chord secured to the ends of the top arch. A web array is secured between the arch and the bottom chord, the web array consisting of vertically oriented planks located at spaced points along the length of both arch and bottom chords. Angularly oriented wooden web members also are secured to said top arch and bottom chord, the junctures along the arch being generally equally spaced, while the junctures along the bottom chord being adjacent to the vertical plank juncture with the bottom chord as a gusset arrangement. The end seating requires massive joints.

Serious functional disadvantages have been encountered in the use of the bowstring type wood truss system per se. Among these are functional failure under stress, e.g. leading to collapse under the weight of heavy snow. Many of the adverse experiences of bowstring wood truss can be traced to defects in the bottom chord, bad knots in the lumber or know clusters or severe slant of grain in the lumber. Rotting at the ends have been encountered leading to sagging of the truss with resulting bending and fracture of the bottom chord. The truss systems of the bowstring type as mentioned, in addition, require unusually long, high quality timbers not readily available in large quantities. Further, massive heavily bolted wood-plank splices are required for timber tension members, a dominating cost factor.

In view of wood truss functional failures that have been encountered, more recent governing design codes have reduced the allowable tension stress in timbers considerably. Design snow loads have been increased by about fifty percent, and in some jurisdictions, even greater loads are required by local building codes. The net result has been an elimination of the cost gap between the wood bowstring truss and the flat steel bar joist system or the rigid steel frame system to which the art has turned as a replacement for wood truss systems so described.

Thus a considerable need has arisen to provide a less expensive, yet structurally improved, load support system capable of construction in situ in the field from stock lumber etc. delivered to the site of erection. Such need is sought to be fulfilled by the hereinafter disclosed invention.

Accordingly, the invention herein provides a wood roof truss construction capable of functioning at least to accepted standards yet being capable of erection with substantial material and labor cost savings.

SUMMARY OF THE INVENTION

The invention provides a wood roof truss construction comprising a backward wood bowstring truss system redundantly superimposed on a single centered rod-tied arch system, with the tie rod being the dominating tension member and assuming a major share of the tension stress in proportion to the load while the wood bichord assumes an minor share thereof. The web system of the truss functions to redistribute whatever imbalance and lack of symmetry occurs in the gravity loading, both systems having a common top chord and a pair of individually functioning bottom chords, the bottom chords being separated, free from interconnection for shear transfer except at the bearing ends of the roof truss construction. The invention provides means for supporting the tension rod which means function also to secure the web system to the bottom chord of the roof truss construction totally without fixed securement of the tension rod to the webs or bottom chord.

The invention provides novel means for supporting the tension rod of the tied arch system in the absence of fixed securement thereof to the bottom chord. Further, an improved coupling assembly is provided for joining the bottom chord to the bearing ends of the arch, and containing therewithin, accessible from the outside, the take-up nut for the rod, providing considerable space of the portion of the rod taken up and extending beyond the nut.

DESCRIPTION OF A PREFERRED EMBODIMENT

Figure 1:
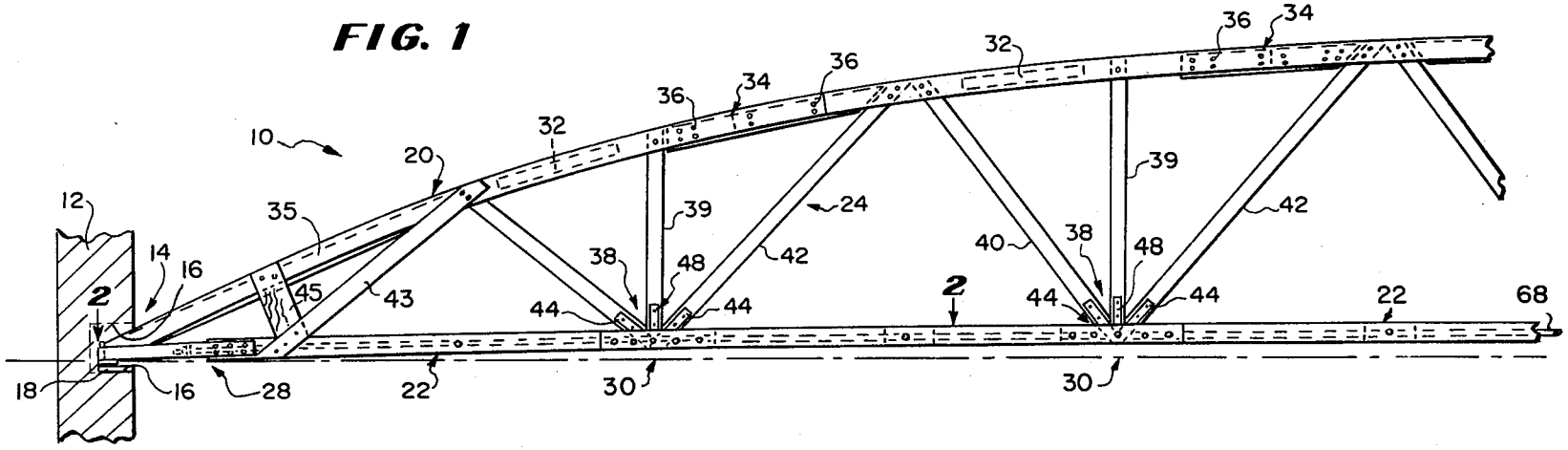
FIG. 1 is a fragmentary elevational view of a wood roof truss construction in accordance with the invention.

Referring to the drawings, the invention provides a wood roof truss construction which is designated generally by reference character 10 in FIG. 1. Wood truss system 10 results from the combination of redundant, superimposed, distinct load-resisting force systems, said systems comprising a tied-arch system and the wood bowstring truss system with the top chord of each system being common and the bottom chords coincident and functioning independently.

The wood roof truss construction 10 is illustrated as installed on a building represented by building wall 12. On the left hand portion of the span is illustrated as the remaining portion which is not shown is constructed substantially identically thereto. The left hand end 14 of the roof truss construction 10 is seated in pocket 16 in wall 12 fastened to bearing plate 18 secured therein. The roof truss 10 is formed of an arch defined by top bichord 20, a bottom bichord 22 and an intervening web formation 24. The bearing ends 26 of arch or top bichord 20 are secured to the ends of the bottom bichord 22 by way of assembly 28 to be described. Lap splices 30, as shown in the drawings, occur at regular spaced intervals along the bottom bichord 22.

The arch or top chord 20, in fact a bichord, comprises plural pairs of wood lengths 30 of glued laminated timber such as No. 1 Douglas Fir or Southern Pine spaced apart by chord filler members 32 disposed therebetween. The wood lengths, are joined end to end at splice filler 34 by bolts and nails, represented by reference character 36. Gusseted web arrays 38 attach to and extend from the bottom chord lap splices 30. The end filler 35 is continuous from its juncture with web 40 at the top chord to its point of abuttment within truss end 26 at the bearing plate 18.

The web formation 24 is formed by spaced arrays 38 of vertical struts 39 and diagonal struts 40 and 42 spanning the space between the top chord 20 and the bottom bichord 22. The gusset arrays 38 take the form of web clusters. Lacing planks 43 and 45 are nailed to the top chord 20 and bottom bichord 22 near the bearing ends 14 of the roof truss 10.

The vertical struts 39 of each gusset array or cluster 38 are secured, as by nailing or bolting directly to the top chord 20 at their upper ends at locations along the span of the roof truss 10.

The diagonal struts 40,42 likewise are secured to the top chord 20 at their upper ends, the struts 40,42 being oriented each diagonally along lines intersecting with the center line of the vertical struts 39 from opposite directions. The bottom ends of the diagonally oriented struts 40,42 are each secured to two strap gussets or plates 44 extending on opposing sides outward therefrom along a straight line.

Figure 2:
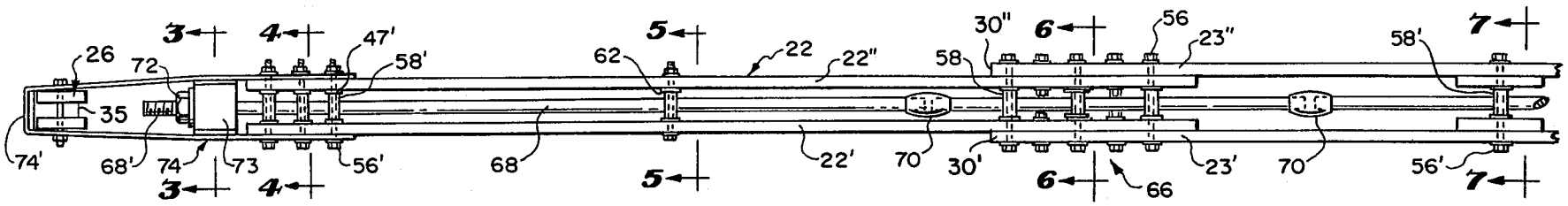
FIG. 2 is a fragmentary sectional view taken along lines 2—2 of FIG. 1 and viewed in the direction indicated.
Figure 3:
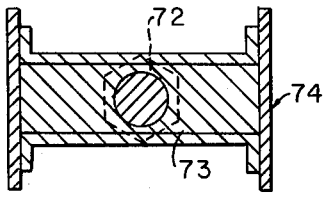
FIG. 3 is an enlarged sectional view taken along lines 3—3 of FIG. 2 and viewed in the direction indicated.
Figure 6:
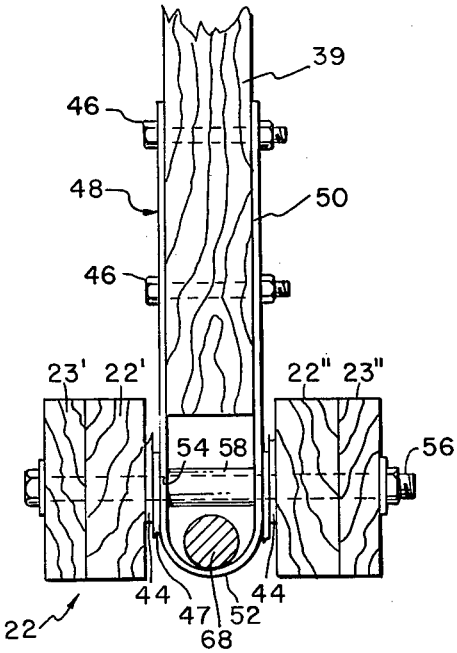
FIG. 6 is an enlarged sectional view taken along lines 6—6 of FIG. 2 and viewed in the direction indicated.

The lower ends of the vertical struts 39 are secured by bolts 46 to the arms 48,50 of the U-strap leaving the arcuate depending heel 52 spaced from the bottom ends of vertical struts 39. Arms 48,50 projecting from heel 52 carry aligned coaxial perforations 54 for accommodating the bolt 56 and spacer sleeve 58 employed to secure together the members 22',22'' defining the bottom bichord 22. As shown in FIGS. 2 and 6, plates 44 extend between the straps and 50 and the bichord members 22',22'' so that the bolt 56 can pass through sleeve 58. The terminal ends of gusset plate 44 are shown sandwiched between arms 48,50 and the bichord members 22',22''.

Figure 5:
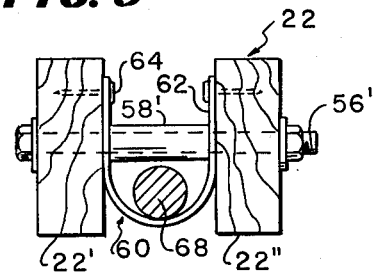
FIG. 5 is an enlarged sectional view taken along lines 5—5 of FIG. 2 and viewed in the direction indicated.
Figure 7:
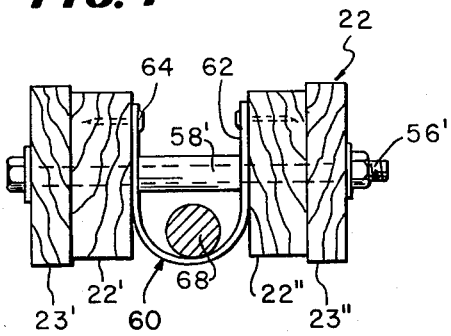
FIG. 7 is an enlarged sectional view taken along lines 7—7 of FIG. 2 and viewed in the direction indicated.

At selected locations spaced along the length of the bottom bichord, U-shaped spacers 60 are provided, the arms 62 thereof being secured by nails 64 to the bichord members 22',22'', as illustrated in FIGS. 5 and 7.

FIG. 5 shows the coupling where the bichord 22 consists only of the pair of spaced beams 22' and 22'' while FIG. 7 illustrates the coupling at locations where a splice 30 is located. Bolt 56 comprises a large pivot bolt which transfers the combined force of the web gusset 38 of the bottom bichord 22, optimally at the splice 30 where the bolt had a double thickness of wood to react against.

The splices 30 between inner and outer pairs 22', 22'' and 23',23'' of the bichord members are located at the web clusters 38 as shown in FIGS. 1 and 2.

A tension rod 68, functioning as the tie-rod of the tied-arch system superpositioned on the bowstring truss system, is located horizontally oriented between the joined members of the bichord, parallel thereto. The tension rod 68 is formed of end-to-end coupled, hot rolled steel rods. Coupling members are provided such as threaded sleeves 70. The tension rod lengths are threaded for engagement with threaded sleeves 70.

In the illustrated roof truss system, the threading of the rods and the coupling sleeves 70 are right-handed to facilitate construction and installation.

The completed rod splice has the tension rod lengths spaced about 2 inches within coupling sleeve 70. The coupled series of individual rod lengths span the overall distance of the bichord disposed therebetween to define a main tension rod with a yield strength approximately 35,000 PSI and a minimum ultimate strength of approximately 60,000 PSI. The tension rod 68 is not secured to the web formation 24 or to any other structural part of the truss 10 except at the opposite bearing ends of the truss 10.

Figure 4:
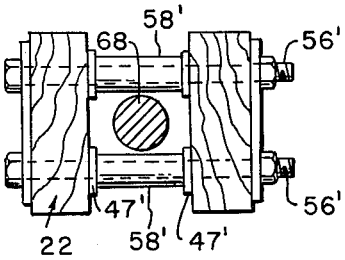
FIG. 4 is an enlarged sectional view taken along lines 4—4 of FIG. 2 and viewed in the direction indicated.

The ends of the bichord members are joined by six bolts 56' with spacer sleeves 58' and suitable washers 47', three being arranged near the top and three near the bottom. The tension rod 68 passes therebetween as shown in FIG. 4. In FIGS. 4 to 7 the bolts also pass through the arms of 48,50 projecting from heel 52, also arms 62 of strap 60. The rod 68 extends through bridging block 73. The tension rod 68 is longer than the bichord members 22',22" so as to be capable of extending past the ends thereof, through said block 73. The free ends 68' of the rod 68 are threaded for accommodating a large nut 72 thereon. The end strap 74 is U-shaped and serves to couple the bichord 22 to the top chord 20 defining the bearing ends of the roof truss 10.

It should be noted that the tension rod 68 is not prestressed although when the end nuts 72 are tightened, there will be some prestressing. In a true prestressing system, the wood as a compression strut would have to possess a strength equal to or exceeding the strength of the rod. This would require too much wood and would substantially increase the cost. Such prestressing is not required with the roof truss system 10.

Before erection and after the strap bolts 56' have been tightened, one can further take-up rod 68 by rotating the large nut 72 one turn. The heel plate 74' of strap 74 seats in the pocket 16 of the building wall 12. The tension rod can be singular, that is comprising the end-to-end lengths of rod threaded at their ends and coupled by the threaded sleeves 70 as shown in FIG. 2, or can be formed of plural rods bundled together and strapped.

It is possible to modify the arrangements of FIGS. 5 and 7 using a pair of concentric bolts vertically aligned similar to the illustration in FIG. 4, instead of one bolt, so that the rod 68 would pass between the two wood chords at the exact geometric center.

As mentioned, the rods use all right-handed threads, also formed in the associated nuts and coupling sleeves, although this is not required.

The wood bottom chord 22 is designed to take one-sixth to one-third of the total required tie force to resist the outward thrust of the top chord, which is an optimum relationship.

As described herein, the net effect of superpositioning the pair of truss systems such as the tied arch truss and the wood bowstring truss constructions, is to provide the superior geometry of the bowstring truss with its economical top chord plus the arching action resisted with a massive tie rod. Normally, the use of dual tie rods is considered desirable in tied arch systems which heretofore have been substituted for bowstring truss structures. With the invention herein, dual bottom chord stability is achieved using only a single tie rod. This results in a system easier to hang from the arch and a rod with reduced surface exposure providing greater fire resistance.

In the composite system of the invention, there results all the cost and strength advantages of both separate systems without the inherent weaknesses of each system when taken alone. The composite system according to the invention may be constructed and erected entirely in the field rather than requiring a steel fabricating plant requiring precision and close tolerances.

The bottom wood bichord utilized is capable of taking one-sixth to one-third of the total required tie force for resisting the outward thrust of the arched top chord. The wood chord can be broken out, the steel tension rod being designed to resist at least two thirds of the total force, and supplying considerable reserve load resisting capacity.

The web system as installed is effective in resisting unbalanced loading as long as the bottom bichord is completely broken in not more than one panel. Where the wood chord is broken, any point on the web structure is still rigidly tied to at least one end of the roof truss construction 10. It should be noted that the above desirable functional advantages are achieved with an esthetically pleasant appearing structure considerably improved over the known industrial installations employing conventional bowstring type truss constructions.

What I claim is:

1. A roof truss construction comprising a pair of redundant super-positioned load resisting force systems, said systems formed of a coincident top chord, a web system depending from said top chord and a pair of individually functioning bottom chords, one of said chords being a word bichord including lap-splices, connected to said web system and the other chord comprising tension rod means disposed longitudinally within said bichord generally parallel thereto and means supporting said tension rod independent of said bichord, said web system including web clusters each comprising a vertical and diagonal strut members depending from said top chord and converging at a common point at the bottom chord, plate means at the point of convergence secured to the bottom ends of each converging strut member, said plate means having first passage means formed horizontally therein and strap means secured to and depending from said plate means and having second passage means formed longitudinally therein for supporting the rod without fixed attachment and said second passage means being aligned in said web cluster and containing spacer means passing therethrough whereby to secure said web cluster to said bottom bichord.

2. The roof truss construction as claimed in claim 1 and secondary strap means located spaced along said bottom bichord and secured fixedly thereto between a pair of web clusters, said tension rod means being seated on said secondary strap means.

3. The roof truss construction as claimed in claim 2 in which said secondary strap means each comprise a U-shaped member having a pair of parallel arms secured to said bichord and a heel portion for freely supporting said tension rod means thereon.

4. The roof truss construction as claimed in claim 1 in which said spacer means includes bolt means securing said bichord in assembly, and located at the lap-splices.

5. The truss construction as claimed in claim 1 in which said tension rod means comprise at least one tension rod having a length less than the distance between the ends of the top chord, strap means separately accommodating each end of the top chord and secured respectively to the ends of the bichord and to the tension rod, and outwardly accessible take-up means coupled to the tension rod at opposite ends of the truss and disposed within said strap means and affording unobstructed inwardly disposed rod protrusion within said strap means.

6. The truss construction as claimed in claim 5 in which said tension rod has threaded ends, bridging block means arranged adjacent said threaded ends and said take-up means comprising tightening nuts engaged on said threaded ends and adapted to be manipulated for take-up of excess length of said tension rod.

7. The roof truss construction as claimed in claim 5 in which, said lap-splices are located at the location of said transverse means, transverse means secured between said spaced members, said web formation being joined in said bichord by said transverse means and said transverse means forming a support for said tension rod means arranged between the members of said bichord free of positive connection to said bichord member.

8. The roof truss construction as claimed in claim 7 in which said transverse means comprise at least one bolt passing through said bichord members and carrying a spacer sleeve thereon between said bichord members.

9. The roof truss construction as claimed in claim 7 in which said transverse means include through-bolts passing through said bichord members fixedly coupled thereto and said tension rod means being located below said through bolts.

10. The roof truss construction as claimed in claim 7 in which said transverse means includes U-straps fastened to said bichord between the members thereof, said U-straps having a heel portion and a pair of arms, bolt means passing therethrough and spacer means on said bolt means and located between said arms of said U-straps, and said heel formation supporting said tension rod.

11. The roof truss construction as claimed in claim 7 in which said transverse means include through bolts passing through said bichord, and said tension rod means is supported thereon.

12. The roof truss construction as claimed in claim 5 and said take-up means comprise tightening means threadably engaged at the opposite ends of said tension rod means and capable of being tightened to take up slack therein.

13. The roof truss construction as claimed in claim 1 in which said rods and sleeves all being threaded in the same direction.

14. The roof truss as claimed in claim 1 in which said web formation is secured to said bichord, gusset means for securing said web formation to said bichord, said gusset means carried separately by each member of said formation and arranged to converge along lines intersecting between said bottom bichord members and bolt means connecting said gusset means to said bichord members, said bolt means comprising a single transversely arranged bolt passing through said bichord members at intersection between said bottom bichord and said bolt means.

* * * * *

UNITED STATES PATENT AND TRADEMARK OFFICE

CERTIFICATE OF CORRECTION

PATENT NO. : 4,393,637

DATED : July 19, 1983

INVENTOR(S) : LEO D. MOSIER

It is certified that error appears in the above-identified patent and that said Letters Patent are hereby corrected as shown below:

At Column 3, line 52, "30" should be deleted;

At Column 3, line 58, "30" should be changed to -- making up the top chord --.

At Column 6, lines 62,63 "said lap-splices are located at the location of said transverse means" should be deleted.

At Column 6, line 63, after "means" insert -- are --.

At Column 6, line 64, -- said lap-splices are located at the location of said transverse means, -- should be inserted after "members".

Signed and Sealed this

Ninth Day of April 1985

[SEAL]

*Attest:*

DONALD J. QUIGG

*Attesting Officer* *Acting Commissioner of Patents and Trademarks*

UNITED STATES PATENT AND TRADEMARK OFFICE

CERTIFICATE OF CORRECTION

PATENT NO. : 4,393,637

DATED : July 19,1983

INVENTOR(S) : LEO D. MOSIER

It is certified that error appears in the above-identified patent and that said Letters Patent are hereby corrected as shown below:

Column 2, line 13, "know" should be -- knot --.

Column 2, line 47, "backward" should be --bichord--.

Column 3, line 39, "On" should be -- Only --.

Column 6, line 13, "word" should be -- wood --.

Signed and Sealed this

*Sixth* Day of *August 1985*

[SEAL]

*Attest:*

DONALD J. QUIGG

*Attesting Officer* *Acting Commissioner of Patents and Trademarks*